US009862888B2

(12) United States Patent
Quanci et al.

(10) Patent No.: US 9,862,888 B2
(45) Date of Patent: Jan. 9, 2018

(54) SYSTEMS AND METHODS FOR IMPROVING QUENCHED COKE RECOVERY

(71) Applicant: SUNCOKE TECHNOLOGY AND DEVELOPMENT LLC., Lisle, IL (US)

(72) Inventors: John Francis Quanci, Haddonfield, NJ (US); Bradley Thomas Rodgers, Glen Carbon, IL (US); Khambath Vichitvongsa, Maryville, IL (US); Chun Wai Choi, Lisle, IL (US); Matt William Gill, Carrolton, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

(21) Appl. No.: 14/952,267

(22) Filed: Nov. 25, 2015

(65) Prior Publication Data

US 2016/0152897 A1 Jun. 2, 2016

Related U.S. Application Data

(63) Continuation of application No. 13/730,598, filed on Dec. 28, 2012, now Pat. No. 9,238,778.

(51) Int. Cl.
*C10B 39/00* (2006.01)
*C10B 39/04* (2006.01)
(Continued)

(52) U.S. Cl.
CPC ..... *C10B 39/14* (2013.01); *C10B 39/00* (2013.01); *C10B 39/04* (2013.01); *C10B 39/08* (2013.01)

(58) Field of Classification Search
CPC ..... C10B 39/08; C10B 39/14; C10B 39/00; C10B 39/02; C10B 39/04;
(Continued)

(56) References Cited

U.S. PATENT DOCUMENTS 469,868 A 3/1892 Osbourn
1,140,798 A 5/1915 Carpenter
(Continued)

FOREIGN PATENT DOCUMENTS

CA 1172895 8/1984
CA 2775992 5/2011
(Continued)

OTHER PUBLICATIONS

Espacenet Translation of DE 3,231,697 C1.*
(Continued)

*Primary Examiner* — Jonathan Miller
*Assistant Examiner* — Jonathan Pilcher
(74) *Attorney, Agent, or Firm* — Perkins Coie LLP

(57) ABSTRACT

The present technology is generally directed to systems and methods for improving quenched coke recovery. More specifically, some embodiments are directed to systems and methods utilizing one or more of a screen, barrier, or reflector panel to contain or redirect coke during or after quenching. In a particular embodiment, a quench car system for containing coke includes a quench car having a base, a plurality of sidewalls, and a top portion. The system can further include a permeable barrier covering at least a portion of the top of the quench car, wherein the permeable barrier has a plurality of apertures therethrough.

11 Claims, 4 Drawing Sheets

(51) Int. Cl.
*C10B 39/08* (2006.01)
*C10B 39/14* (2006.01)

(58) Field of Classification Search
CPC .... B01D 2247/107; B61D 7/32; B61D 11/02; B61D 9/06; B61D 9/00; B61D 45/006
See application file for complete search history.

(56) References Cited

U.S. PATENT DOCUMENTS 1,424,777 A 8/1922 Schondeling
1,430,027 A 9/1922 Plantinga
1,486,401 A 3/1924 Van Ackeren
1,572,391 A 2/1926 Kiaiber
1,677,973 A 7/1928 Marquard
1,721,813 A 7/1929 Geipert
1,818,370 A 8/1931 Wine
1,818,994 A 8/1931 Kreisinger
1,848,818 A 3/1932 Becker
1,955,962 A 4/1934 Jones
2,075,337 A 3/1937 Burnaugh
2,394,173 A 2/1946 Harris et al.
2,424,012 A 7/1947 Bangham et al.
2,667,185 A 1/1954 Beavers
2,723,725 A 11/1955 Keiffer
2,756,842 A 7/1956 Chamberlin et al.
2,873,816 A 2/1959 Emil et al.
2,902,991 A 9/1959 Whitman
3,015,893 A 1/1962 McCreary
3,033,764 A 5/1962 Hannes
3,462,345 A 8/1969 Kernan
3,511,030 A 5/1970 Brown et al.
3,545,470 A 12/1970 Paton
3,592,742 A 7/1971 Thompson
3,616,408 A 10/1971 Hickam
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,836,161 A 10/1974 Pries
3,839,156 A 10/1974 Jakobi et al.
3,844,900 A 10/1974 Schulte
3,857,758 A 12/1974 Mole
3,875,016 A 4/1975 Schmidt-Balve
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,984,289 A 10/1976 Sustarsic et al.
4,004,702 A 1/1977 Szendroi
4,004,983 A 1/1977 Pries
4,040,910 A 8/1977 Knappstein et al.
4,045,299 A 8/1977 MacDonald
4,059,885 A 11/1977 Oldengott
4,067,462 A 1/1978 Thompson
4,083,753 A 4/1978 Rogers et al.
4,086,231 A 4/1978 Ikio
4,100,033 A 7/1978 Holter
4,111,757 A 9/1978 Carimboli
4,124,450 A 11/1978 MacDonald
4,141,796 A 2/1979 Clark et al.
4,145,195 A 3/1979 Knappstein et al.
4,147,230 A 4/1979 Ormond et al.
4,162,546 A 7/1979 Shortell et al.
4,189,272 A 2/1980 Gregor et al.
4,194,951 A 3/1980 Pries
4,196,053 A 4/1980 Grohmann
4,211,608 A 7/1980 Kwasnoski et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wagener et al.
4,296,938 A 10/1981 Offermann et al.
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,498,786 A 2/1985 Ruscheweyh
4,506,025 A 3/1985 Kleeb et al.
4,508,539 A 4/1985 Nakai
4,527,488 A 7/1985 Lindgren
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,704,195 A 11/1987 Janicka et al.
4,720,262 A 1/1988 Durr et al.
4,726,465 A 2/1988 Kwasnik et al.
4,793,931 A 12/1988 Doyle et al.
4,824,614 A 4/1989 Jones et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,227,106 A 7/1993 Kolvek
5,228,955 A 7/1993 Westbrook, III
5,318,671 A 6/1994 Pruitt
5,423,152 A 6/1995 Kolvek

(56) References Cited

U.S. PATENT DOCUMENTS

| | | | | |
|---|---|---|---|---|
| 5,480,594 | A | 1/1996 | Wilkerson et al. | |
| 5,622,280 | A | 4/1997 | Mays et al. | |
| 5,670,025 | A | 9/1997 | Baird | |
| 5,687,768 | A | 11/1997 | Albrecht et al. | |
| 5,787,821 | A | 8/1998 | Bhat et al. | |
| 5,810,032 | A | 9/1998 | Hong et al. | |
| 5,857,308 | A | 1/1999 | Dismore et al. | |
| 5,928,476 | A | 7/1999 | Daniels | |
| 5,968,320 | A | 10/1999 | Sprague | |
| 6,017,214 | A | 1/2000 | Sturgulewski | |
| 6,059,932 | A | 5/2000 | Sturgulewski | |
| 6,139,692 | A | 10/2000 | Tamura et al. | |
| 6,152,668 | A | 11/2000 | Knoch | |
| 6,187,148 | B1 | 2/2001 | Sturgulewski | |
| 6,189,819 | B1 | 2/2001 | Racine | |
| 6,290,494 | B1 | 9/2001 | Barkdoll | |
| 6,412,221 | B1 | 7/2002 | Emsbo | |
| 6,596,128 | B2 | 7/2003 | Westbrook | |
| 6,626,984 | B1 | 9/2003 | Taylor | |
| 6,699,035 | B2 | 3/2004 | Brooker | |
| 6,758,875 | B2 | 7/2004 | Reid et al. | |
| 6,907,895 | B2 | 6/2005 | Johnson et al. | |
| 6,946,011 | B2 | 9/2005 | Snyder | |
| 6,964,236 | B2 | 11/2005 | Schucker | |
| 7,056,390 | B2 | 6/2006 | Fratello | |
| 7,077,892 | B2 | 7/2006 | Lee | |
| 7,314,060 | B2 | 1/2008 | Chen et al. | |
| 7,331,298 | B2 | 2/2008 | Barkdoll et al. | |
| 7,497,930 | B2 | 3/2009 | Barkdoll et al. | |
| 7,611,609 | B1 | 11/2009 | Valia et al. | |
| 7,644,711 | B2 | 1/2010 | Creel | |
| 7,722,843 | B1 | 5/2010 | Srinivasachar | |
| 7,727,307 | B2 | 6/2010 | Winkler | |
| 7,803,627 | B2 | 9/2010 | Hodges et al. | |
| 7,827,689 | B2 | 11/2010 | Crane | |
| 7,998,316 | B2 | 8/2011 | Barkdoll | |
| 8,071,060 | B2 | 12/2011 | Ukai et al. | |
| 8,079,751 | B2 | 12/2011 | Kapila et al. | |
| 8,152,970 | B2 | 4/2012 | Barkdoll et al. | |
| 8,236,142 | B2 * | 8/2012 | Westbrook | C10B 33/003 201/39 |
| 8,266,853 | B2 | 9/2012 | Bloom et al. | |
| 8,398,935 | B2 | 3/2013 | Howell et al. | |
| 9,238,778 | B2 * | 1/2016 | Quanci | C10B 39/08 |
| 9,243,186 | B2 | 1/2016 | Quanci et al. | |
| 9,249,357 | B2 | 2/2016 | Quanci et al. | |
| 2002/0170605 | A1 | 11/2002 | Shiraishi et al. | |
| 2003/0014954 | A1 | 1/2003 | Ronning et al. | |
| 2003/0015809 | A1 | 1/2003 | Carson | |
| 2006/0102420 | A1 | 5/2006 | Huber et al. | |
| 2007/0116619 | A1 | 5/2007 | Taylor et al. | |
| 2007/0251198 | A1 | 11/2007 | Witter | |
| 2008/0028935 | A1 | 2/2008 | Andersson | |
| 2008/0169578 | A1 | 7/2008 | Crane et al. | |
| 2008/0179165 | A1 | 7/2008 | Chen et al. | |
| 2008/0257236 | A1 | 10/2008 | Green | |
| 2008/0271985 | A1 | 11/2008 | Yamasaki | |
| 2008/0289305 | A1 | 11/2008 | Girondi | |
| 2009/0152092 | A1 | 6/2009 | Kim et al. | |
| 2009/0217576 | A1 | 9/2009 | Kim et al. | |
| 2009/0283395 | A1 | 11/2009 | Hippe | |
| 2010/0095521 | A1 | 4/2010 | Kartal et al. | |
| 2010/0115912 | A1 | 5/2010 | Worley | |
| 2010/0287871 | A1 | 11/2010 | Bloom et al. | |
| 2010/0300867 | A1 | 12/2010 | Kim et al. | |
| 2011/0048917 | A1 | 3/2011 | Kim et al. | |
| 2011/0120852 | A1 | 5/2011 | Kim | |
| 2011/0174301 | A1 | 7/2011 | Haydock et al. | |
| 2011/0192395 | A1 | 8/2011 | Kim | |
| 2011/0223088 | A1 | 9/2011 | Chang et al. | |
| 2011/0253521 | A1 | 10/2011 | Kim | |
| 2011/0315538 | A1 | 12/2011 | Kim et al. | |
| 2012/0024688 | A1 | 2/2012 | Barkdoll | |
| 2012/0030998 | A1 | 2/2012 | Barkdoll et al. | |
| 2012/0152720 | A1 | 6/2012 | Reichelt et al. | |
| 2012/0228115 | A1 | 9/2012 | Westbrook | |
| 2012/0247939 | A1 | 10/2012 | Kim et al. | |
| 2012/0305380 | A1 | 12/2012 | Wang et al. | |
| 2013/0216717 | A1 | 8/2013 | Rago et al. | |
| 2013/0220373 | A1 | 8/2013 | Kim | |
| 2013/0306462 | A1 | 11/2013 | Kim et al. | |
| 2014/0033917 | A1 | 2/2014 | Rodgers et al. | |
| 2014/0048402 | A1 | 2/2014 | Quanci et al. | |
| 2014/0061018 | A1 | 3/2014 | Sarpen et al. | |
| 2014/0083836 | A1 | 3/2014 | Quanci et al. | |
| 2014/0182195 | A1 | 7/2014 | Quanci et al. | |
| 2014/0182683 | A1 | 7/2014 | Quanci et al. | |
| 2014/0183023 | A1 | 7/2014 | Quanci et al. | |
| 2014/0183024 | A1 | 7/2014 | Chun et al. | |
| 2014/0183026 | A1 | 7/2014 | Quanci et al. | |
| 2014/0224123 | A1 | 8/2014 | Walters | |
| 2014/0262139 | A1 | 9/2014 | Choi et al. | |
| 2014/0262726 | A1 | 9/2014 | West et al. | |
| 2015/0122629 | A1 | 5/2015 | Freimuth et al. | |
| 2015/0247092 | A1 | 9/2015 | Quanci et al. | |
| 2015/0328576 | A1 | 9/2015 | Quanci et al. | |
| 2015/0287026 | A1 | 10/2015 | Quanci et al. | |
| 2016/0032193 | A1 | 2/2016 | Sarpen et al. | |
| 2016/0060532 | A1 | 3/2016 | Quanci et al. | |
| 2016/0060533 | A1 | 3/2016 | Quanci et al. | |
| 2016/0060534 | A1 | 3/2016 | Quanci et al. | |
| 2016/0060536 | A1 | 3/2016 | Quanci et al. | |
| 2017/0015908 | A1 | 1/2017 | Quanci et al. | |

FOREIGN PATENT DOCUMENTS

| | | | | |
|---|---|---|---|---|
| CA | 2822841 | | 7/2012 | |
| CA | 2822857 | | 7/2012 | |
| CN | 87212113 | U | 6/1988 | |
| CN | 87107195 | A | 7/1988 | |
| CN | 2064363 | | 10/1990 | |
| CN | 1092457 | A | 9/1994 | |
| CN | 1255528 | A | 6/2000 | |
| CN | 2528771 | Y | 2/2002 | |
| CN | 1358822 | A | 7/2002 | |
| CN | 2521473 | Y | 11/2002 | |
| CN | 1468364 | A | 1/2004 | |
| CN | 1527872 | A | 9/2004 | |
| CN | 2668641 | | 1/2005 | |
| CN | 1957204 | A | 5/2007 | |
| CN | 101037603 | A | 9/2007 | |
| CN | 101058731 | A | 10/2007 | |
| CN | 101157874 | A | 4/2008 | |
| CN | 201121178 | Y | 9/2008 | |
| CN | 100510004 | C | 7/2009 | |
| CN | 101486017 | A | 7/2009 | |
| CN | 101497835 | A | 8/2009 | |
| CN | 2509188 | Y | 11/2011 | |
| CN | 202226816 | | 5/2012 | |
| CN | 102584294 | A | 7/2012 | |
| CN | 103468289 | A | 12/2013 | |
| DE | 212176 | | 7/1909 | |
| DE | 1212037 | B | 3/1966 | |
| DE | 3231697 | C1 * | 1/1984 | C10B 39/04 |
| DE | 3231697 | C1 | 1/1984 | |
| DE | 3315738 | C2 | 3/1984 | |
| DE | 3329367 | C | 11/1984 | |
| DE | 3328702 | A1 | 2/1985 | |
| DE | 19545736 | | 6/1997 | |
| DE | 19803455 | | 8/1999 | |
| DE | 10122531 | A1 | 11/2002 | |
| DE | 10154785 | | 5/2003 | |
| DE | 102005015301 | | 10/2006 | |
| DE | 102006004669 | | 8/2007 | |
| DE | 102006026521 | A1 | 12/2007 | |
| DE | 102009031436 | | 1/2011 | |
| DE | 102011052785 | | 12/2012 | |
| EP | 0208490 | | 1/1987 | |
| EP | 2295129 | | 3/2011 | |
| FR | 2339664 | | 8/1977 | |
| GB | 441784 | | 1/1936 | |
| GB | 606340 | | 8/1948 | |
| GB | 611524 | | 11/1948 | |
| GB | 725865 | | 3/1955 | |

(56) References Cited

FOREIGN PATENT DOCUMENTS

| | | | |
|---|---|---|---|
| GB | 871094 | | 6/1961 |
| JP | S50148405 | | 11/1975 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | 06264062 | | 9/1994 |
| JP | 07188668 | | 7/1995 |
| JP | 07216357 | | 8/1995 |
| JP | 08127778 | | 5/1996 |
| JP | H10273672 | A | 10/1998 |
| JP | 2000204373 | A | 7/2000 |
| JP | 2001200258 | | 7/2001 |
| JP | 2002106941 | | 4/2002 |
| JP | 2003041258 | | 2/2003 |
| JP | 2003071313 | | 3/2003 |
| JP | 2003292968 | A | 10/2003 |
| JP | 2003342581 | A | 12/2003 |
| JP | 2005263983 | A | 9/2005 |
| JP | 2007063420 | A | 3/2007 |
| JP | 2008231278 | A | 10/2008 |
| JP | 2009144121 | | 7/2009 |
| JP | 2012102302 | | 5/2012 |
| JP | 2013006957 | A | 1/2013 |
| KR | 1019960008754 | | 10/1996 |
| KR | 1019990054426 | | 7/1999 |
| KR | 20000042375 | A | 7/2000 |
| KR | 100296700 | B1 | 10/2001 |
| KR | 1020050053861 | A | 6/2005 |
| KR | 100737393 | B1 | 7/2007 |
| KR | 100797852 | | 1/2008 |
| KR | 1020110010452 | A | 2/2011 |
| KR | 101318388 | | 10/2013 |
| SU | 1535880 | A1 | 1/1990 |
| TW | 201241166 | A | 10/2012 |
| WO | WO9012074 | | 10/1990 |
| WO | WO9945083 | | 9/1999 |
| WO | WO2005023649 | | 3/2005 |
| WO | WO2005115583 | | 12/2005 |
| WO | WO2007103649 | | 9/2007 |
| WO | WO2008034424 | | 3/2008 |
| WO | WO2011000447 | | 1/2011 |
| WO | WO2012029979 | | 3/2012 |
| WO | WO2013023872 | | 2/2013 |
| WO | WO2010107513 | | 9/2013 |
| WO | WO2014021909 | | 2/2014 |

OTHER PUBLICATIONS

English Abstract of DE 3,231,697 C1 obtianed from Espacenet.*

U.S. Appl. No. 15/139,568, filed Apr. 27, 2016, Quanci et al.

Canadian Office Action in Canadian Application No. 2,896,473, dated May 5, 2016, 5 pages.

Chinese Office Action in Chinese Application No. 201280077764.X, dated Jun. 27, 2016.

Extended European Search Report in European Application No. 12890832.4, dated Jun. 13, 2016, 7 pages.

Waddell, et al., "Heat-Recovery Cokemaking Presentation," Jan. 1999, pp. 1-25.

Westbrook, "Heat-Recovery Cokemaking at Sun Coke," AISE Steel Technology, Pittsburg, PA, vol. 76, No. 1, Jan. 1999, pp. 25-28.

Yu et al., "Coke Oven Production Technology," Lianoning Science and Technology Press, first edition, Apr. 2014, pp. 356-358.

"Resources and Utilization of Coking Coal in China," Mingxin Shen ed., Chemical Industry Press, first edition, Jan. 2007, pp. 242-243, 247.

U.S. Appl. No. 15/322,176, filed Dec. 27, 2016, West et al.

U.S. Appl. No. 15/392,942, filed Dec. 28, 2016, Quanci et al.

U.S. Appl. No. 15/443,246, filed Feb. 27, 2017, Quanci et al.

Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.

Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.

U.S. Appl. No. 14/959,450, filed Dec. 4, 2015, Quanci et al.

U.S. Appl. No. 14/983,857, filed Dec. 30, 2015, Quanci et al.

U.S. Appl. No. 14/984/489, filed Dec. 30, 2015, Quanci et al.

U.S. Appl. No. 14/986,281, filed Dec. 31, 2015, Quanci et al.

U.S. Appl. No. 14/987,625, filed Jan. 4, 2016, Quanci et al.

U.S. Appl. No. 15/014,547, filed Feb. 3, 2016, Choi et al.

ASTM D5341-99(2010)e1, Standard Test Method for Measuring Coke Reactivity Index (CRI) and Coke Strength After Reaction (CSR), ASTM International, West Conshohocken, PA, 2010.

Basset, et al., "Calculation of steady flow pressure loss coefficients for pipe junctions," Proc Instn Mech Engrs., vol. 215, Part C. IMechIE 2001.

Clean coke process: process development studies by USS Engineers and Consultants, Inc., Wisconsin Tech Search, request date Oct. 5, 2011, 17 pages.

Costa, et al., "Edge Effects on the Flow Characteristics in a 90 deg Tee Junction," Transactions of the ASME, Nov. 2006, vol. 128, pp. 1204-1217.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

International Search Report and Written Opinion of International Application No. PCT/US2012/072166; dated Sep. 25, 2013; 11 pages.

JP 03-197588, Inoqu Keizo et al., Method and Equipment for Boring Degassing Hole in Coal Charge in Coke Oven, Japanese Patent (Abstract Only) Aug. 28, 1991.

JP 04-159392, Inoue Keizo et al., Method and Equipment for Opening Hole for Degassing of Coal Charge in Coke Oven, Japanese Patent (Abstract Only) Jun. 2, 1992.

Rose, Harold J., "The Selection of Coals for the Manufacture of Coke," American Institute of Mining and Metallurgical Engineers, Feb. 1926, 8 pages.

* cited by examiner

SYSTEMS AND METHODS FOR IMPROVING QUENCHED COKE RECOVERY

CROSS-REFERENCE TO RELATED APPLICATIONS

This application is a continuation of U.S. patent application Ser. No. 13/730,598, filed Dec. 28, 2012, the disclosure of which is incorporated by reference in its entirety.

TECHNICAL FIELD

The present technology is generally directed to systems and methods for improving quenched coke recovery. More specifically, some embodiments are directed to systems and methods utilizing one or more of a screen, barrier, or reflector panel to contain or redirect coke during or after quenching.

BACKGROUND

Quenching is an important step in many types of mineral processing, including coke processing. During quenching, a quench tower releases a large amount of water onto heated coke in a quench car in order to quickly cool the coke. The pre-quench coke is extremely hot, sometimes having a temperature greater than 2,000 degrees Fahrenheit. Once the coke is cooled, it can be handled on transfer belts and be screened and sent to the customer.

Traditionally, a large amount of coke is lost in the quenching process. More specifically, the combination of the force of the quench spray and the expansion of the quench water as it forms steam causes some of the coke to pop or fly out of the top and upper side edges of the quench car. This coke then falls by the wayside or is passed into a collecting water pit. To recover this coke, the water pit must be dredged, a costly and time-consuming process. The coke recovered from the pit is high in moisture and requires drying and sieving to reclaim, as the coke must have a relatively low moisture content to be useful to many customers. Therefore, there exists a need to improve coke recovery during the quench process.

DETAILED DESCRIPTION

The present technology is generally directed to systems and methods for improving quenched coke recovery. More specifically, some embodiments are directed to systems and methods utilizing one or more of a screen, barrier, or reflector panel to contain or redirect coke during or after quenching. In a particular embodiment, a quench car system for containing coke includes a quench car having a base, a plurality of sidewalls, and a top portion. The system can further include a permeable barrier covering at least a portion of the top of the quench car, where the permeable barrier has a plurality of apertures therethrough.

In another embodiment, a coke quenching system includes a quench car having a plurality of sidewalls for containing coke and a quench tower configured to supply fluid for quenching the coke. The quench tower includes a deflection barrier positioned over the quench car and configured to contain coke in the car.

In another embodiment, a coke quench car includes a base and a plurality of sidewalls extending generally orthogonally upward from the base and surrounding a central region configured to contain coke. Individual sidewalls can comprise a lower portion adjacent to the base and an upper portion opposite the lower portion. The upper portion of at least one sidewall can be angled laterally inward toward the central region.

Specific details of several embodiments of the technology are described below with reference to FIGS. 1-5. Other details describing well-known structures and systems often associated with coal processing and/or quenching have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-5.

Figure 1:
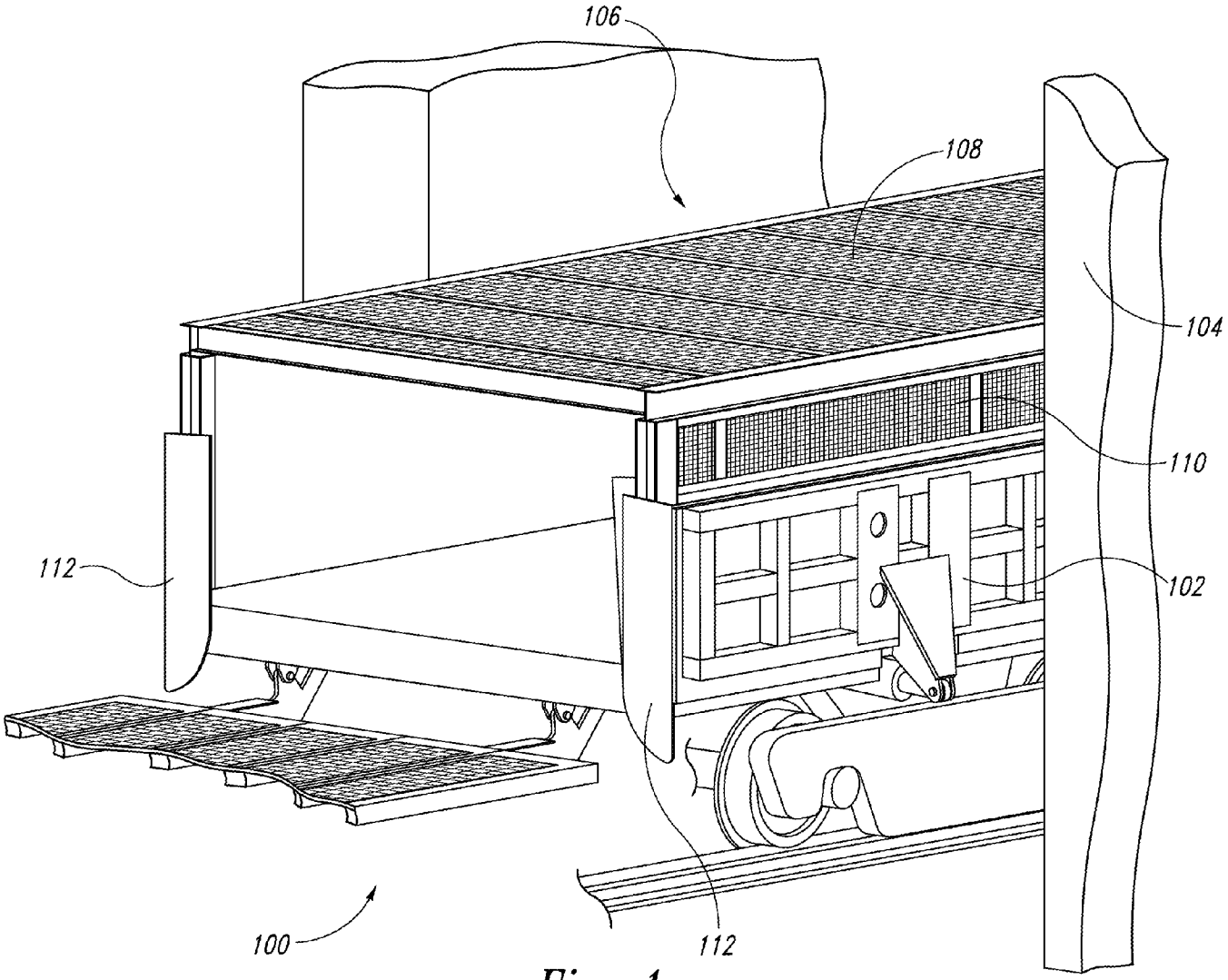
FIG. 1 is an isometric, partial cut-away view of a quench car that is entering a quench tower and is configured in accordance with embodiments of the technology.

FIG. 1 is an isometric, partial cut-away view of a quench car 100 that is entering a quench tower 104 and is configured in accordance with embodiments of the technology. The quench car 100 includes a plurality of sidewalls 102 arranged to enclose or at least partially surround a space configured to contain coke in a coke processing system. In further embodiments, the quench car 100 can be used in other mineral processing systems. While the car 100 is described herein as a "quench" car, it can comprise a "hot" car configured to receive coke from a coke oven, a quench train, a coke-moving car, a combined hot/quench car, or other container.

The quench car 100 includes a permeable deflection barrier 106 having a top portion 108 and one or more sidewall portions 110. In some embodiments, the barrier 106 comprises only one of a top portion 108 or sidewall portion 110, or extends across only a portion of the top of the quench car 100. In various embodiments, the top portion 108 is integral with the sidewall portions 110 or can be detachably coupled to the sidewall portions 110 or to the sidewalls 102. While the barrier sidewall portion 110 is illustrated as occupying only an upper portion of the sidewalls 102, in further embodiments more or less of the sidewalls 102 can comprise the permeable barrier. For example, including apertures or a permeable barrier on a lower portion of the sidewalls 102 can allow quench water to exit the car 100 after the quench and prevent the coke from sitting in quench fluid.

The permeable barrier 106 can be removably or permanently coupled to the quench car 100, or it can be spaced apart from (e.g., positioned above) the quench car 100. For example, as will be discussed in further detail below, the barrier 106 can be held above the car 100 by the quench tower 104 or other structure. In embodiments where the permeable barrier 106 is removably coupled to the quench car 100, the permeable barrier can be latched, friction fit, draped over, or held by cords, chains, hinges, or hooks to the car 100. For example, the barrier 106 can be coupled to the car 100 (e.g., to a sidewall 102) with a hinge or similar device and can open like an automobile hood. In some embodiments, the barrier 106 can have a lock or latch to fix the barrier 106 in a closed or open configuration. In some embodiments, the permeable barrier 106 can lift or otherwise be moved during car loading or unloading. In further embodiments, other attachment mechanisms can be used. The barrier 106 can be angled or generally horizontal. In some embodiments, the car 100 can include quench spray nozzles under the barrier 106 that can provide all or a portion of the quench fluid.

The permeable barrier 106 can comprise one or more of a screen, curtain, mesh, or other structure configured to contain coke during the quench process while allowing quench fluid to pass therethrough and reach the contained coke. In particular embodiments, the permeable barrier 106 comprises a screen having apertures therein. In some embodiments, the apertures have a diameter of approximately 0.25 inch to about 0.75 inch. In another particular embodiment, the apertures have dimensions of about 1.6 inch by about 0.56 inch. In still further embodiments, different portions of the barrier 106 can have different size apertures. For example, in some embodiments, one sidewall portion 110 can have larger apertures than an opposing sidewall portion 110. In another embodiment, an aperture pattern on the barrier 106 can match or complement a nozzle pattern in the quench tower 104. For example, the barrier 106 can have larger apertures on regions of the top portion 108 that are positioned under nozzles in the quench tower 104. These larger apertures can better receive quench water. In still further embodiments, apertures are exclusively placed under quench tower nozzles. In other embodiments, other aperture patterns are used to optimize quench water distribution in the quench car 100. Further, the apertures can have different shapes in different embodiments of the technology.

In some embodiments, the barrier 106 comprises stainless steel, high-carbon steel, AR400-AR500 steel, or other suitable material that can withstand the temperature and humidity conditions of the quench process. In a particular embodiment, a chain-link-fence type of material can be used as a barrier 106. In another embodiment, steel chains can be used. The barrier 106 can be flexible or rigid.

In some embodiments, the quench car 100 includes a deflection or containment plate 112 coupled to the sidewall 102. In various embodiments, as will be described in further detail below, one or more containment plates 112 can be coupled to other sidewalls, quench car gates, the barrier 106, or the base of the quench car 100. In particular embodiments, the containment plate 112 can be positioned at a junction or corner between two sidewalls or between a sidewall and a top or base portion of the car 100. The containment plate 112 can overlap at least a portion of a sidewall 102 or car base.

The containment plate 112 can have different shapes in various embodiments of the technology. For example, the containment plate 112 can be shaped as a rectangle, circle, triangle, or other shape. The containment plate 112 can be curved or otherwise shaped to complement the shape of the quench car 100 or can be shaped to achieve a funneling or confining effect on the coke during processing. For example, as will be described in further detail below with reference to FIG. 2, the containment plate 112 shown in FIG. 1 is shaped as a fin extending along an edge of the sidewall 102. In some embodiments, the containment plate 112 can fit against the car 100 tightly enough to contain coke while allowing used quench water to pass out of the car 100 to prevent the contained coke from sitting in water. The containment plate 112 can be on an internal or external surface of the quench car 100, or it can extend from an internal to an external portion. The containment plate 112 can be a solid surface or can have apertures therein.

In operation, the barrier 106 can serve to contain coke and/or reflect "popping" coke back into the quench car 100 during quenching. More specifically, the barrier 106 can be sufficiently permeable to allow quench fluid to pass through and reach the coke while having small enough apertures to prohibit coke from jumping or popping from the car 100. The barrier 106 further allows quench steam to escape the car. The barrier sidewall portions 110 can further allow a cross-breeze to flow over the cooling coke.

Figure 2A:
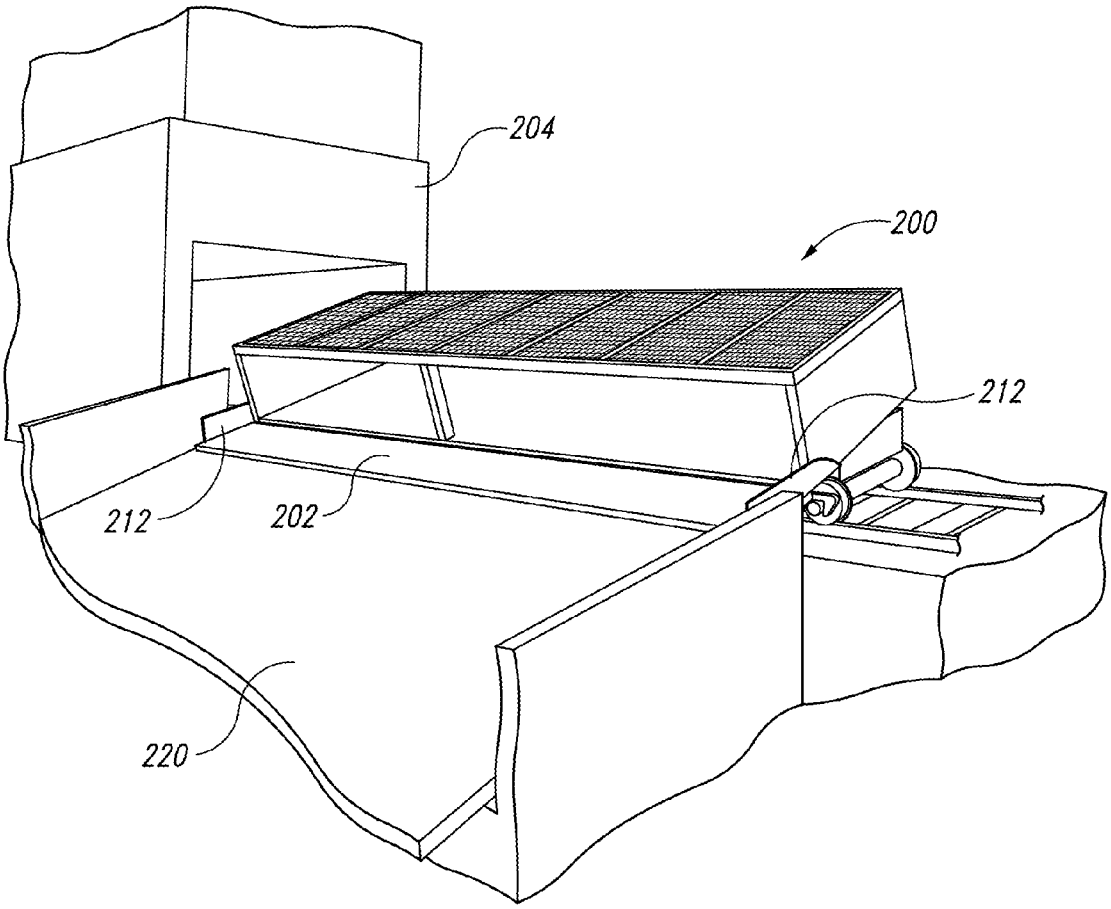
FIG. 2A is an isometric view of a quench car that has side containment plates for channeling quenched coke onto a quench wharf and is configured in accordance with embodiments of the technology.

FIG. 2A is an isometric view of a quench car 200 having side containment plates 212 configured to channel quenched coke onto a quench wharf 220 after the coke has been quenched in a quench tower 204. As described above with reference to FIG. 1, the quench car 200 can have containment plates 212 coupled to a sidewall 202 of the car 200. In the illustrated embodiment, the sidewall 202 functions as a dump gate; when the car 200 is tilted toward the wharf and the sidewall gate 202 is open, the quenched coke is funneled by the containment plates 212 onto the wharf 220 to reduce side spillage. In further embodiments, the containment plates 212 can serve to contain the coke during quenching or can prevent the coke from spilling out of the car 200 at junction points (i.e., the junction between two adjacent sidewalls or a sidewall and the base of the car 200).

Figure 2B:
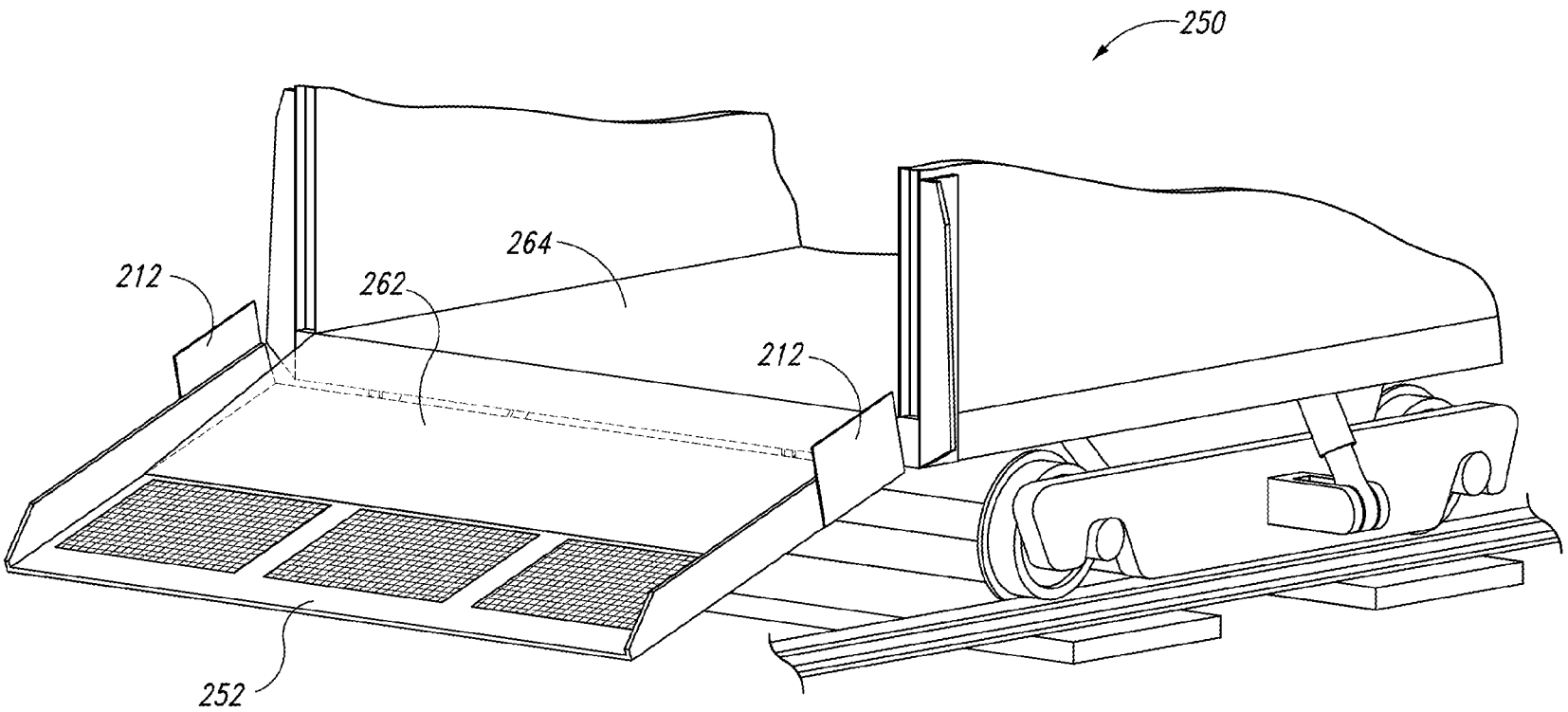
FIG. 2B is an isometric, partial cut-away view of a quench car having a tailgate containment plate configured in accordance with embodiments of the technology.

FIG. 2B is an isometric partial cut-away view of a quench car 250 having a tailgate containment plate 262 configured in accordance with embodiments of the technology. The tailgate containment plate 262 functions generally in the manner of the containment plates 212 described above with reference to FIG. 2A. More specifically, the tailgate containment plate 262 can bridge space between a base 264 of the car 250 and a sidewall gate 252. In several embodiments, the tailgate containment plate 262 is inclined relative to the base 264 of the car 250 and the sidewall gate 252. When the gate 252 is open, the tailgate containment plate 262 can prevent coke from falling between an opening between the base 264 and the gate 252. The tailgate containment plate 262 can further inhibit coke from building up at this junction and preventing the gate 252 from opening and closing. In several embodiments, the tailgate containment plate 262 is movable relative to the sidewall gate 252 and/or the base 264 such that the tailgate containment plate 262 assumes different positions depending on whether the sidewall gate 252 is open or closed.

FIG. 2B also illustrates that the gate 252 can have a solid lower portion and a permeable upper portion. In further embodiments, the gate 252 can be fully solid or fully permeable, or the lower portion can be permeable and the upper portion can be solid. In still further embodiments, the gate 252 can comprise multiple, separate portions (e.g., an upper portion and a lower portion) that can move independently of each other. In still further embodiments, the upper portion can be fixed (e.g., fixed to the car sidewalls) and the lower portion can be movable (i.e., open and close on a hinge) relative to the fixed upper portion. The upper and lower portions can be any combination of permeable and impermeable surfaces. In embodiments where at least a portion of the gate 252 is solid, the solid portion can help contain or channel quench steam. In some embodiments, the gate 252 joins or can be sealed against a top portion (e.g., the top portion 108 shown in FIG. 1) when the gate 252 is in a closed configuration.

Figure 3:
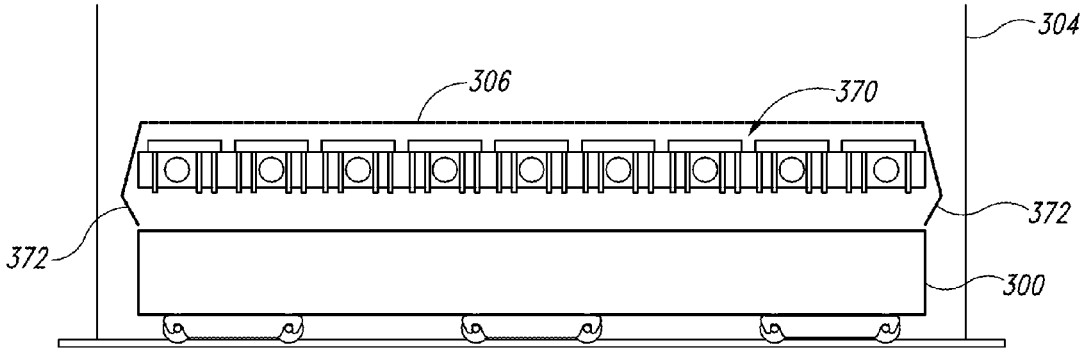
FIG. 3 is a partially schematic illustration of a quench car positioned in a quench tower that has coke retaining features and is configured in accordance with embodiments of the technology.

FIG. 3 is a partially schematic illustration of a quench car 300 positioned in a quench tower 304 that has coke retaining features and is configured in accordance with embodiments of the technology. The quench tower 304 can be a byproduct quench tower, heat recovery quench tower, or any other similar system. The quench tower 304 includes a barrier 306 coupled thereto. The barrier 306 can be attached to any portion of the quench tower 304 framework and in various embodiments can be positioned above or below an array 370 of quench nozzles. In embodiments where the barrier 306 is below the nozzle array 370, the barrier 306 can be permeable to allow quench fluid to flow through. In embodiments where the barrier 306 is coplanar or above the nozzle array 370, the barrier 306 can be permeable or impermeable. In any of these embodiments, the barrier 306 can serve to reflect or contain coke in the quench car 300 in the manner described above with reference to FIG. 1. In still further embodiments, as discussed above with reference to FIG. 1, the nozzle array 370 and barrier 306 can be positioned on the quench car 300 (either in addition to or lieu of placement on the tower 304).

In several embodiments, the barrier 306 can further comprise one or more sidewall portions 372 that extend downward from the generally horizontal plane. In further embodiments, the barrier 306 exclusively has sidewall portions 372 and not an upper portion. The sidewall portions 372 can be rigid or flexible curtains and can channel coke that flies during the quench process back into the quench car 300. In various embodiments, the sidewall portions 372 can comprise numerous generally adjacent panels/chains or a single continuous panel. In still further embodiments, the sidewall portions 372 can be positioned on a track, rod, or other similar system to extend along or around the quench car 300 and then move away from the car 300 when not in use. In various embodiments, the barrier 306 or sidewall portions 372 are permanent in their placement relative to the quench tower 304 or can be retracted upward into the quench tower 304 and drop downward over the car 300. In other embodiments, the barrier 306 can be dropped over the car 300 and/or retracted upward outside of the quench tower 304 by a crane or other lifting/dropping device. In further embodiments, the barrier 306 can detach from the quench tower 304. In some embodiments, a bottom portion of the sidewall portions 372 can be positioned in the interior portion of the car 300, such that any coke that hits the sidewall portions 372 will slide back into the car 300. In further embodiments, a bottom portion of the sidewall portions 372 is exterior of the car 300.

Figure 4:
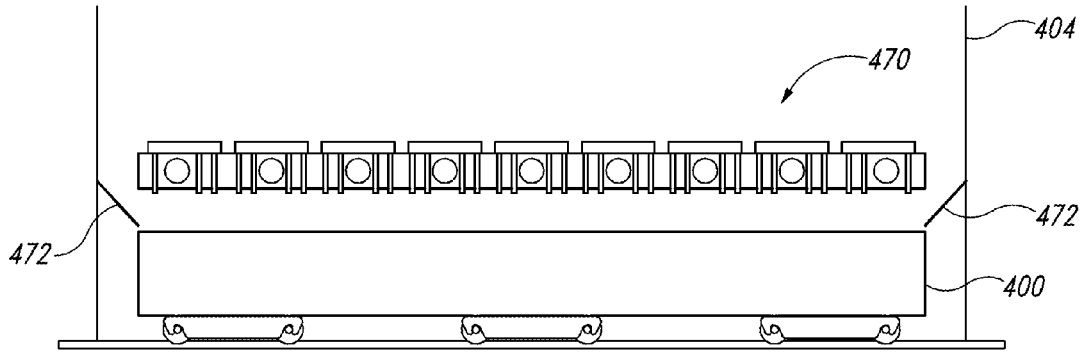
FIG. 4 is a partially schematic illustration of a quench car positioned in a quench tower that has coke retaining features and is configured in accordance with further embodiments of the technology.

FIG. 4 is a partially schematic illustration of a quench car 400 positioned in a quench tower 404 having coke reclaim plates 472 configured in accordance with further embodiments of the technology. In the illustrated embodiment, the reclaim plates 472 extend downward and slope laterally inward toward the quench car 400. In other embodiments, the reclaim plates 472 can have different angles either more or less directed inward toward the car 400. The reclaim plates 472 can channel coke that flies during the quench process back into the quench car 400 to increase coke recovery and reduce build-up at the base of the quench tower 404. In further embodiments, the reclaim plates 472 are coupled to the car 400 instead of or in addition to being coupled to the quench tower 404. Further, in some embodiments, the reclaim plates 472 can be movable to adjust their angle with reference to the quench tower 404. This adjustability can be useful to vary the coke diversion characteristics of the reclaim plates 472 or to accommodate different sizes of quench cars 400 or movement of the car 400 with reference to the quench tower 404 (e.g., the reclaim plates 472 can fold away while the car 400 is driving into or out of the quench tower 404). While the illustrated embodiment shows the reclaim plates 472 below a nozzle array 470, in further embodiments the reclaim plates 472 are above or coplanar with the nozzle array 470.

Figure 5:
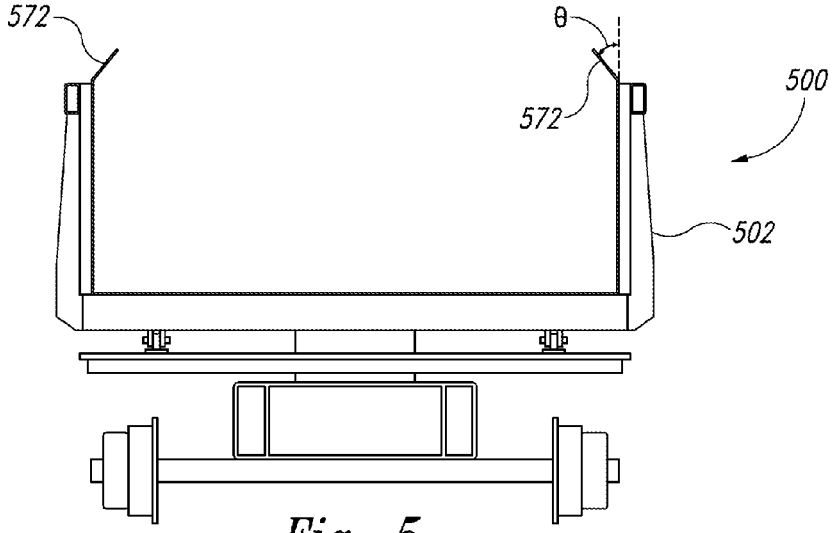
FIG. 5 is a front view of a quench car having coke retaining features configured in accordance with embodiments of the technology.

FIG. 5 is a front view of a quench car 500 having containment plates 572 configured in accordance with embodiments of the technology. The containment plates 572 can extend upward from sidewalls 502 of the car 500 and reflect coke back into the car 500 during the quench process. The containment plates 572 can comprise any permeable or impermeable material, or a combination of these materials. For example, in a particular embodiment, a portion of the containment plates 572 closest to the sidewalls 502 is solid and impermeable while a portion of the containment plates 572 that extends farthest into the center of the car 500 is permeable. All or only some of the sidewalls 502 may include containment plates 572. For example, in some embodiments, only two opposing sidewalls 502 have containment plates thereon. In particular embodiments, the containment plates 572 are on one or more drain or dump gates on the car 500.

While the sidewalls 502 can be generally orthogonal to the base of the car 500, the containment plates 572 can be angled inward at angle θ such that flying coke hits the bottom of the containment plates 572 and deflects downward. The angle θ can vary in alternate embodiments of the technology or can be adjustable (e.g., the containment plates 572 can be on hinges). In particular embodiments, the angle θ can be from about 10 degrees to about 90 degrees relative to a vertical plane. The containment plates 572 can reduce coke breeze from moving downstream or clogging process flow. In some embodiments, the car 500 can further include a top portion, such as the top portion 108 described above with reference to FIG. 1, that extends between sidewalls 502 (e.g., between the containment plates 572. The containment plates 572 can be used alone or in conjunction with any of the top portions (solid or permeable) described above.

EXAMPLES

1. A quench car system for containing coke prepared for quenching at a quenching site, the quench car system comprising:
   - a quench car having a base and a plurality of sidewalls defining an opening, the quench car having a top; and
   - a permeable barrier covering at least a portion of the top of the quench car, the permeable barrier having a plurality of apertures therethrough.

2. The quench car system of example 1 wherein the permeable barrier is removably coupled to the quench car.

3. The quench car system of example 1 wherein the permeable barrier extends across the top of the quench car and at least one sidewall.

4. The quench car system of example 1 wherein the individual apertures have a diameter from about ¼ inch to about ¾ inch.

5. The quench car system of example 1 wherein the quench car further comprises a containment plate coupled to one or more sidewalls and configured to contain or funnel coke or quench water.

6. The quench car system of example 5 wherein an individual sidewall comprises a movable gate, and wherein the containment plate extends along the gate and is movable between a first position when the gate is open and a second position when the gate is closed.

7. The quench car system of example 5 wherein two sidewalls meet at a corner, and wherein the containment plate is positioned adjacent to the corner and overlaps at least one of the sidewalls.

8. The quench car system of example 1 wherein the permeable barrier is permanently coupled to the quench car.

9. The quench car system of example 1 wherein the permeable barrier comprises stainless steel.

10. The quench car system of example 1 wherein the permeable barrier is spaced apart from the top of the quench car.

11. The quench car system of example 1, further comprising a quench tower having a nozzle positioned above the quench car, wherein an individual aperture generally vertically aligned with the nozzle has a diameter larger than a diameter of another individual aperture.

12. A coke quenching system, comprising:

a quench car having a plurality of sidewalls for containing coke; and a quench tower configured to supply fluid for quenching coke, wherein the quench tower includes a deflection barrier positioned over the quench car and configured to contain coke in the car.

13. The coke quenching system of example 12 wherein the quench tower includes a nozzle, and wherein the deflection barrier comprises an angled deflection plate coupled to or positioned below the nozzle.

14. The coke quenching system of example 12 wherein the quench tower includes a plurality of nozzles directed toward the quench car, and wherein the deflection barrier is positioned above the nozzles.

15. The coke quenching system of example 12 wherein the deflection barrier comprises a permeable barrier.

16. The coke quenching system of example 12 wherein the deflection barrier comprises a plurality of vertical draping barriers.

17. The coke quenching system of example 12 wherein the deflection barrier comprises a movable barrier.

18. The coke quenching system of example 12, wherein deflection barrier comprises a plurality of confining plates.

19. The coke quenching system of example 18 wherein the confining plates extend laterally inward toward an interior portion of the quench tower and are angled relative to a horizontal plane.

20. The coke quenching system of example 12 wherein the quench tower includes a plurality of nozzles directed toward the quench car, and wherein the deflection barrier comprises a permeable barrier positioned at or below the nozzles.

21. The coke quenching system of example 12 wherein the deflection barrier comprises a chain mesh.

22. A coke quench car, comprising:

a base; and a plurality of sidewalls extending generally orthogonally upward from the base and surrounding a central region configured to contain coke, wherein the individual sidewalls comprise a lower portion adjacent to the base and an upper portion opposite the lower portion, and wherein the upper portion of at least one sidewall is angled laterally inward toward the central region.

23. The coke quench car of example 22 wherein the upper portion comprises a solid barrier.

24. The coke quench car of example 22 wherein the upper portion is angled inward at an angle from about 10 degrees to about 90 degrees relative to a vertical plane.

25. The coke quench car of example 22 wherein the upper portions of two opposing sidewalls are angled laterally inward toward the central region.

26. The coke quench car of example 22 wherein the upper portions are movable between a first angle and a second angle.

27. The coke quench car of example 22 wherein two sidewalls meet at a corner, and wherein the quench car further comprises a laterally extending fin that is coupled to the car adjacent to the corner and is configured to contain or funnel coke or quench water.

28. The coke quench car of example 22 wherein the upper portion comprises an at least partially permeable barrier.

29. The coke quench car of example 22, further comprising a top portion configured to extend across at least a portion of the central region, wherein the top portion comprises an at least partially permeable barrier.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A quench car system for containing coke prepared for quenching at a quenching site, the quench car system comprising:

a quench car having a base and a plurality of sidewalls defining an interior, designed to carry a volume of coke, and an open upper end portion; and a permeable barrier substantially covering and operatively coupled with the open upper end portion of the quench car, and positioned to be in a vertically spaced-apart relationship from the volume of coke; the permeable barrier having a plurality of unobstructed apertures therethrough that allow quench fluid to enter the quench car and quench steam to escape the quench car to an environment surrounding the quench car.

2. The quench car system of claim 1 wherein the permeable barrier is removably coupled to the quench car.

3. The quench car system of claim 1 wherein the permeable barrier extends across the open upper end portion of the quench car and at least one sidewall.

4. The quench car system of claim 1 wherein the individual apertures have a diameter from about ¼ inch to about ¾ inch.

5. The quench car system of claim 1 wherein the quench car further comprises a containment plate coupled to one or more sidewalls and positioned with respect to the one or more sidewalls to contain or funnel coke or quench water.

6. The quench car system of claim 5 wherein an individual sidewall comprises a movable gate, and wherein the containment plate is operatively coupled to and extends along the gate, such that the containment plate is movable between a first position when the gate is open and a second position when the gate is closed.

7. The quench car system of claim 5 wherein two sidewalls meet at a corner, and wherein the containment plate is positioned adjacent to the corner and overlaps at least one of the sidewalls.

8. A quench car system for containing coke prepared for quenching at a quenching site, the quench car system comprising:

a quench car having a base and a plurality of sidewalls defining an interior, designed to carry a volume of coke, and an open upper end portion; and a permeable barrier permanently coupled to and substantially covering, the open upper end portion of the quench car, and positioned to be in a vertically spaced-apart relationship from the volume of coke; the permeable barrier having a plurality of apertures therethrough.

9. The quench car system of claim 1 wherein the permeable barrier comprises stainless steel.

10. The quench car system of claim 1 wherein the permeable barrier is spaced apart from the open upper end portion of the quench car.

11. The quench car system of claim 1, further comprising a quench tower having a nozzle positioned above the quench car, wherein an individual aperture of the permeable barrier is generally vertically aligned with the nozzle and has a diameter larger than a diameter of another individual aperture of the permeable barrier.

* * * * *